US010060592B2

(12) United States Patent
Yan et al.

(10) Patent No.: US 10,060,592 B2
(45) Date of Patent: Aug. 28, 2018

(54) DUAL BEAM PATTERN VEHICULAR LIGHTING ASSEMBLY

(71) Applicant: Ford Global Technologies, LLC, Dearborn, MI (US)

(72) Inventors: Li Yan, Troy, MI (US); Ketan K. Desai, Farmington Hills, MI (US); David A. Brown, West Bloomfield, MI (US); Stephen Kenneth Helwig, Farmington Hills, MI (US); Sleiman N. Abdelnour, Macomb, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 21 days.

(21) Appl. No.: 14/448,583

(22) Filed: Jul. 31, 2014

(65) Prior Publication Data

US 2016/0033101 A1 Feb. 4, 2016

(51) Int. Cl.
*F21V 21/00* (2006.01)
*F21S 8/10* (2006.01)
(Continued)

(52) U.S. Cl.
CPC ..... *F21S 48/1283* (2013.01); *F21S 41/143* (2018.01); *F21S 41/24* (2018.01);
(Continued)

(58) Field of Classification Search
CPC ..... F21S 48/1258; F21S 48/1159; F21S 48/1283; F21S 41/24; F21S 41/275;
(Continued)

(56) References Cited

U.S. PATENT DOCUMENTS 6,062,710 A 5/2000 Hewitt
6,951,416 B2 10/2005 Sazuka et al.
(Continued)

FOREIGN PATENT DOCUMENTS

JP 2011165441 A 8/2011
JP 2012243727 A 12/2012

OTHER PUBLICATIONS

Oliver Dross, Aleksandra Cvetkovic, Julio Chaves, Pablo Benitez, and Juan C. Minano; "LED Headlight Architecture that creates a High Quality Beam Pattern Independent of LED Shortcomings," pp. 1-10, Proc. SPIE 5942, Nonimaging Optics and Efficient Illumination Systems II, 59420D (Published Aug. 22, 2005).

*Primary Examiner* — Anh Mai
*Assistant Examiner* — Meghan Ulanday
(74) *Attorney, Agent, or Firm* — Jason Rogers; Price Heneveld LLP

(57) ABSTRACT

A vehicle lighting assembly that comprises: a single lens having a first and a second plurality of near-field lens elements, and an exit surface; and a first and a second LED source that directs light through the respective first and second plurality of lens elements. The first and the second plurality of lens elements are configured to transmit light in a respective spread pattern and a high-intensity pattern through the exit surface. The assemblies can be configured such that the spread pattern and the high-intensity pattern collectively meet the low beam headlight requirements set forth in any current global vehicular lighting regulation, e.g., the current U.S. NHTSA Motor Vehicle Safety Standard No. 108.

18 Claims, 3 Drawing Sheets

(51) Int. Cl.

| | |
|---|---|
| ***F21S 41/143*** | (2018.01) |
| ***F21S 41/20*** | (2018.01) |
| ***F21S 41/24*** | (2018.01) |
| ***F21S 41/275*** | (2018.01) |
| ***F21S 41/32*** | (2018.01) |
| ***F21S 41/663*** | (2018.01) |

(52) U.S. Cl.
CPC ..... *F21S 41/275* (2018.01); *F21S 41/285* (2018.01); *F21S 41/322* (2018.01); *F21S 41/663* (2018.01)

(58) Field of Classification Search
CPC ..... F21S 41/663; F21S 41/322; F21S 41/143; F21S 41/285; F21V 5/04
USPC ..... 362/487, 509, 520, 522, 545
See application file for complete search history.

(56) References Cited

U.S. PATENT DOCUMENTS

| | | | | |
|---|---|---|---|---|
| 7,815,350 | B2 | 10/2010 | Valcamp et al. | |
| 8,104,939 | B2 | 1/2012 | Coushaine et al. | |
| 8,469,565 | B2 | 6/2013 | Yatsuda | |
| 2001/0021110 | A1 | 9/2001 | Nakayama et al. | |
| 2005/0138852 | A1 | 6/2005 | Yamauchi | |
| 2007/0091613 | A1 | 4/2007 | Lee et al. | |
| 2009/0003002 | A1 | 1/2009 | Sato | |
| 2009/0213608 | A1 | 8/2009 | Mozaffari-Afshar et al. | |
| 2011/0169410 | A1* | 7/2011 | Dassanayake ..... | F21S 48/1136 315/82 |
| 2011/0286221 | A1 | 11/2011 | Saito | |
| 2011/0317442 | A1 | 12/2011 | Makiuchi | |
| 2012/0075849 | A1 | 3/2012 | Potter | |
| 2012/0120672 | A1 | 5/2012 | Stagg et al. | |
| 2012/0268940 | A1 | 10/2012 | Sahlin et al. | |
| 2013/0265791 | A1 | 10/2013 | Dassanayake et al. | |
| 2014/0192547 | A1* | 7/2014 | Kumar ..... | B60Q 1/00 362/522 |

* cited by examiner

DUAL BEAM PATTERN VEHICULAR LIGHTING ASSEMBLY

FIELD OF THE INVENTION

The present invention generally relates to lighting modules and assemblies and, more particularly, to vehicular headlamp assemblies.

BACKGROUND OF THE INVENTION

Conventional vehicle headlamps employ numerous components (e.g., a light source, collector, and light distributor). Even more advanced vehicle headlamps employing light emitting diode ("LED") light sources often have numerous components, typically pairing each LED source with a lens. Automotive designs generally place certain size and dimensional limitations on vehicle headlamps. Further, the sizing of headlamps can in part be dictated by beam spread requirements dictated by federal regulations, depending on the particular application for the headlamp (e.g., low beam, high beam, etc.). Headlamps with numerous components with larger packaging footprints, even if employing more energy-efficient light sources, can present disadvantages in terms of their contributions to vehicle weight.

Accordingly, there is a need for vehicular lighting modules and assemblies that offer shape and packaging flexibility, particularly for use in headlamp applications requiring particular beam spread patterns.

SUMMARY OF THE INVENTION

According to one aspect of the present invention, a vehicle lighting assembly is provided that comprises: a single lens having a first and second plurality of near-field lens elements, and an exit surface; and a first and second LED source that directs light through the respective first and second plurality of lens elements. The first and the second plurality of lens elements are configured to transmit light in a respective spread pattern and a high-intensity pattern through the exit surface.

According to another aspect of the present invention, a vehicle lighting assembly is provided that comprises: a single lens having a first and second plurality of near-field lens elements and exit elements; and a first and second LED source that directs light through the respective first and second plurality of lens elements. The first and the second plurality of lens elements are configured to transmit light in a respective spread pattern and a high-intensity pattern through the respective first and second plurality of exit elements.

According to a further aspect of the present invention, a vehicle lighting assembly is provided that comprises: a single lens having a plurality of lens modules, and an exit surface; and a plurality of LED sources that direct light through the plurality of lens modules. The plurality of lens modules is configured to transmit light in a respective spread pattern and high-intensity pattern through the exit surface and each lens module comprises two or more near-field lens elements.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
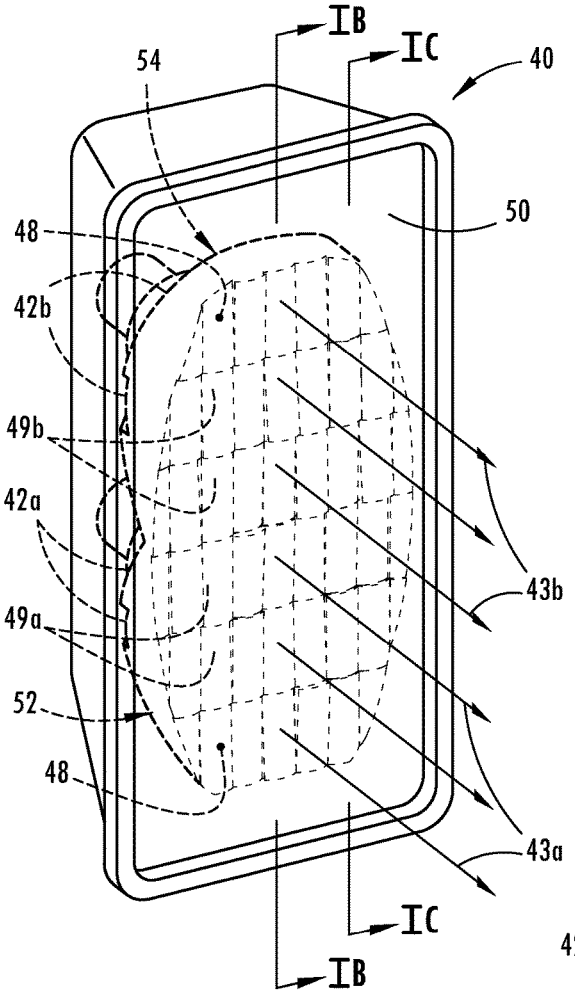
FIG. 1 is a front, perspective view of a vehicle headlamp assembly that includes a pair of vehicle lens modules with substantially rectangular exit surfaces according to an aspect of this disclosure.

For purposes of description herein, the terms "upper," "lower," "right," "left," "rear," "front," "vertical," "horizontal," and derivatives thereof shall relate to the invention as oriented in FIG. 1. However, the invention may assume various alternative orientations, except where expressly specified to the contrary. Also, the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1A:
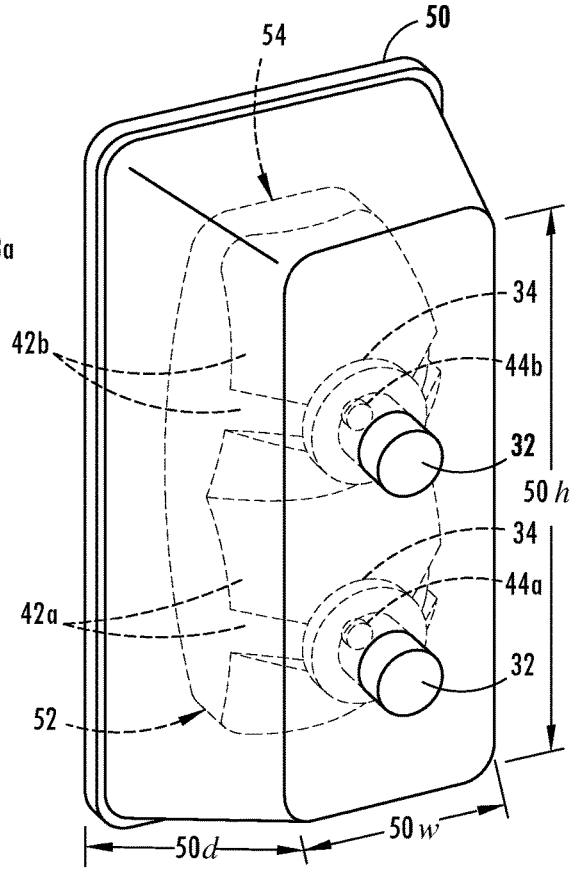
FIG. 1A is a rear, perspective view of the vehicle headlamp assembly depicted in FIG. 1.
Figure 1B:
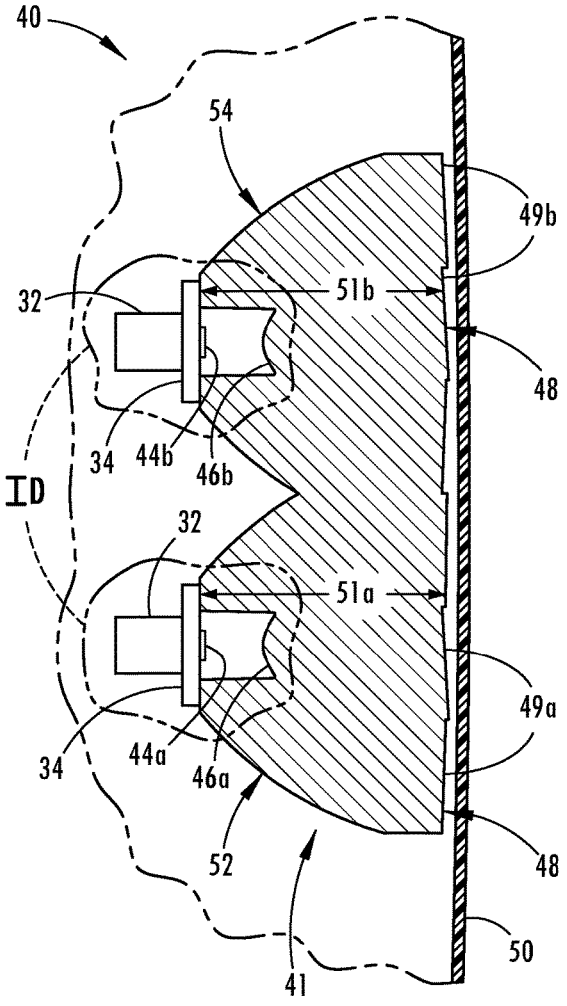
FIG. 1B is a cross-sectional view of the vehicle headlamp assembly depicted in FIG. 1 at line IB-IB.
Figure 1C:
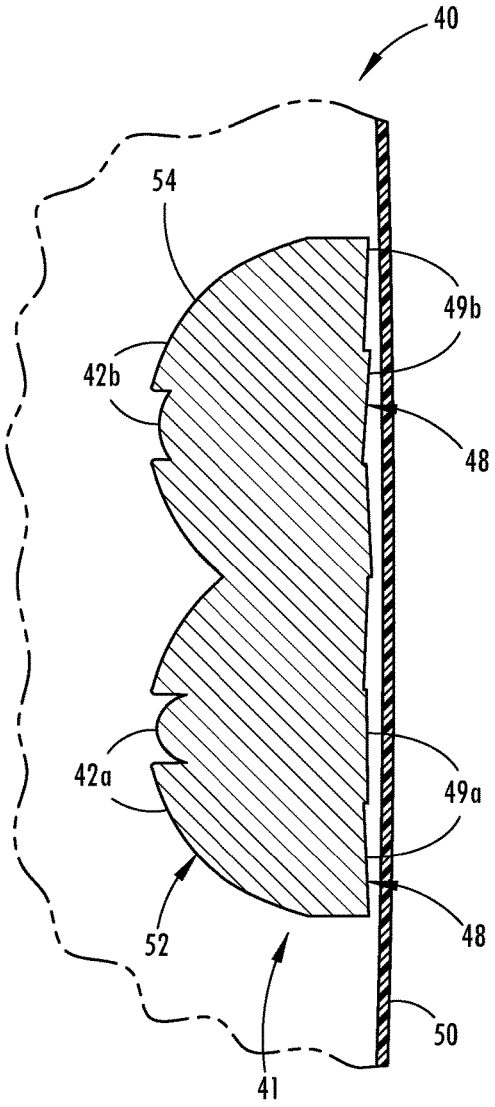
FIG. 1C is a cross-sectional view of the vehicle headlamp assembly depicted in FIG. 1 at line IC-IC.

Referring to FIGS. 1-1C, a vehicle headlamp assembly 40 is depicted according to an aspect of the disclosure with a pair of adjacent lens modules 52, 54 configured within a headlamp case 50. Modules 52, 54 can be configured to produce spread (e.g., relatively large, low intensity region) and spot (e.g., a small, high intensity region) light patterns 43*a* and 43*b*, respectively. In some embodiments, the light patterns 43*a* and 43*b* can collectively satisfy the low beam headlight requirements set forth in any current global vehicular lighting regulation, e.g., the current U.S. National Highway Traffic Safety Administration ("NHTSA") Motor Vehicle Safety Standard No. 108 ("FMVSS 108"). Together, the modules 52, 54 embody a lens 41 having an exit surface 48. The headlamp assembly 40 further includes LED light sources 44*a* and 44*b* such that each source directs incident light through the respective lens modules 52, 54 and lens 41. In some embodiments, LED light sources 44*a* and 44*b* are mounted to printed circuit boards (PCBs) 34 and heat sinks 32 (see FIGS. 1A and 1B).

As also depicted in FIGS. 1-1C, the lens 41 includes a first and second plurality of near-field lens ("NFL") elements 42*a* and 42*b* that correspond to the respective lens modules 52 and 54. These near-field lens elements 42*a* and 42*b* are configured to transmit from the exit surface 48 of the lens 41 respective spread and spot light patterns 43*a* and 43*b* containing at least a substantial portion of the incident light from LED light sources 44*a* and 44*b*. Further, the exit surface 48 of lens 41 is depicted as substantially rectangular in shape, whereas input surfaces 46*a* and 46*b* (see FIG. 1B) of the lighting modules 52 and 54 are substantially circular in shape. In addition, the exit surface 48 of the lens 41 includes a first and second plurality of exit surface elements 49*a* and 49*b*. The exit surface elements 49*a* and 49*b* correspond to the lens modules 52 and 54 and LED light sources 44*a* and 44*b*, respectively.

According to an embodiment, the LED light sources 44*a* and 44*b* of the vehicle headlamp assembly 40 produce light that is generally directed into the input surfaces 46*a* and 46*b* of the lens modules 52, 54, respectively (see FIG. 1B). The input surfaces 46*a* and 46*b* are each configured according to dimensional and mathematical relationships to collimate the light from the sources 44*a* and 44*b* into spot and spread patterns 43*a* and 43*b*. For example, input surfaces 46*a* and 46*b* may be generally parabolic in nature to collimate and reflect incident light from the sources 44*a* and 44*b* outward from the assembly as patterns 43*a* and 43*b* as shown in FIGS. 1, 1B and 1C.

Referring again to FIGS. 1-1C, the incident light that travels through the input surfaces 46*a* and 46*b* leaves the lens 41 via the exit surface 48. In some aspects, the exit surface 48 can be configured with a first and second plurality of exit surface elements 49*a* and 49*b* to further refine or otherwise shape the light patterns produced by the input surfaces 46*a* and 46*b* into spread and spot patterns 43*a* and 43*b*. As such, each of the exit surface elements 49*a* and 49*b* can include a collection of optical elements that can be configured to further optimize the uniformity of the spread and spot patterns 43*a* and 43*b*. For example, the tip angle (e.g., about a lateral vehicular axis in a vehicle forward or rearward direction) and outer curvature (e.g., convex, concave, bowed, etc.) of each element 49*a*, 49*b* can be individually adjusted to optimize the uniformity and directionality of the spread and spot patterns 43*a* and 43*b* (see, e.g., FIG. 1). In a preferred arrangement of the vehicle headlamp assembly 40, a substantial quantity of the total number of elements 49*a* and 49*b* are dissimilar in terms of their tip angle and/or outer curvature (see FIGS. 1, 1B and 1C).

The lens 41 and, particularly the exit surface 48, can take on a variety of shapes, including the substantially rectangular shape depicted in FIGS. 1-1C. In some embodiments, the exit surface 48 is arranged in a substantially circular or elliptical configuration. Packaging requirements and particular spread and intensity levels required by the final application can also influence the final shape factor chosen for the lens 41 and the exit surface 48. As for the input surfaces 46*a* and 46*b*, they are generally arranged in a substantially circular configuration to efficiently collect the majority of incident light from the LED light sources 44*a* and 44*b*. The input surfaces 46*a* and 46*b* can also be configured in substantially rectangular configurations to accommodate LED light sources 44*a* and 44*b* that produce incident light in a substantially linear pattern.

Figure 1D:
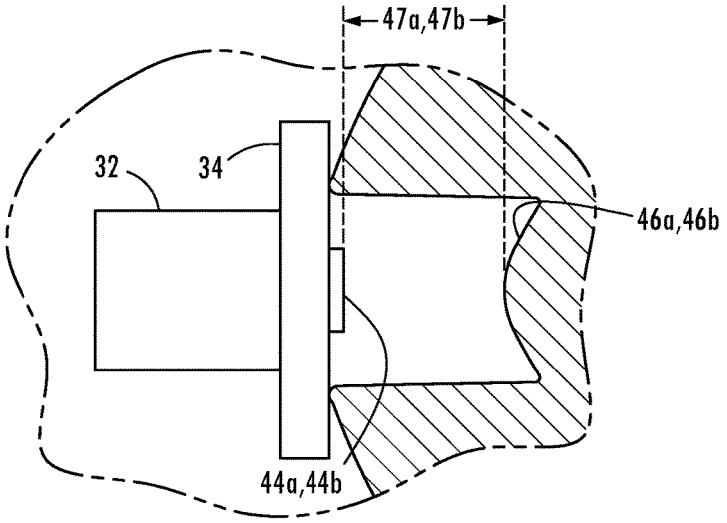
FIG. 1D is an enlarged view of the LEDs and input surfaces in the vehicle headlamp assembly depicted in FIG. 1.

As shown in FIG. 1D, the LED distances 47*a*, 47*b* between the LED light sources 44*a*, 44*b* and input surfaces 46*a*, 46*b* can be controlled to affect the uniformity, spread and location of the spread and spot patterns 43*a* and 43*b*. In some preferred implementations, an LED distance 47*a* of about 5 mm and an LED distance 47*b* of about 6 mm are employed in the vehicular headlamp assembly 40 to produce suitable spread and spot patterns 43*a* and 43*b*. It should also be understood that LED distances 47*a* and 47*b* can be optimized and adjusted to produce various beam spread patterns that are the sum of spread and spot patterns 43*a* and 43*b* for various headlamp or other lighting requirements and/or governmental regulations.

Referring again to FIGS. 1-1C, the lens 41 can be fabricated from an optically translucent material, such as polycarbonate, glass or other comparable materials. Generally, the materials used to fabricate the lens 41 have a high optical quality and are capable of being manufactured to tight tolerances. The exit surface 48, NFL elements 42*a* and 42*b*, and input surfaces 46*a* and 46*b* are integrated within the lens 41. Accordingly, lens 41 is typically fabricated from one piece of material.

The LED light sources 44*a* and 44*b* can be selected from various LED lighting technologies, including those that can emanate light of wavelengths other than in the visible spectrum or various colors. Further, various color filters and other optical elements (e.g., diffusers) can be employed immediately in front of or part of the light sources 44*a* and 44*b* to produce certain desired optical effects associated with the spread and spot patterns 43*a* and 43*b*. It should be understood that the LED light sources 44*a* and 44*b* are located in proximity to the input surfaces 46*a* and 46*b* to facilitate the efficient collection of incident light by the surfaces 46*a* and 46*b* of the lens 41.

As further shown in FIGS. 1-1C, the plurality of NFL elements 42*a* and 42*b* of the vehicle headlamp assembly 40 can be configured to transmit collimated light patterns, e.g., spread and spot patterns 43*a* and 43*b*, containing a substantial percentage of incident light from LED light sources 44*a* and 44*b*. In some aspects, at least 60% of the incident light from the sources 44*a* and 44*b* is transmitted through the exit surface 48. In other aspects, it is preferable to configure the NFL elements 42*a* and 42*b* such that at least 70% of the incident light (or at least 80% of the incident light in some configurations) is transmitted through the exit surface 48. There are relatively few aspects of the vehicle headlamp assembly 40 that can lead to a loss of light intensity. The incident light from LED light sources 44*a* and 44*b* is directed immediately into input surfaces 46*a* and 46*b*. Thereafter, the light is redirected and collimated by the plurality of NFL elements 42*a* and 42*b* within lens 41. There are no other surfaces that reflect incident light—a process that usually results in 10-20% loss in light intensity. Hence, the overall light transmission efficiency of the vehicle headlamp assembly 40 can exceed 60%.

As shown in FIG. 1B, the internal lens distances 51*a*, 51*b* between the input surfaces 46*a*, 46*b* and the exit surface elements 49*a*, 49*b* can also be controlled to affect the uniformity, spread and location of the spread and spot patterns 43*a* and 43*b*. In a preferred implementation, an internal lens distance 51*a*, 51*b* of less than about 28 mm can be employed in the vehicular headlamp assembly 40 to produce efficient spread and spot patterns 43*a* and 43*b*. It should also be understood that internal lens distances 51*a* and 51*b* can be optimized and adjusted to produce various beam spread patterns that are the sum of spread and spot patterns 43*a* and 43*b* for various headlamp or other lighting requirements and/or governmental regulations.

As noted earlier, the NFL elements 42*a* and 42*b* in FIGS. 1-1C of the vehicle headlamp assembly 40 are configured to collimate the incident light from LED light sources 44*a* and 44*b*. The incident light from the sources 44*a* and 44*b* is usually Lambertian in character with significant scattering in various directions. In other words, light emanates and spreads from the source in all directions—on the order of 180 degrees. It should also be understood that each NFL element 42*a*, 42*b* can consist of a plurality of NFL lenses. In some embodiments, each lens may possess a focal length that is the same or differs from the focal lengths of the other lenses in the NFL elements 42*a*, 42*b*. In some aspects of the headlamp assembly 40, each NFL element 42*a*, 42*b* consists of two NFL lenses, each lens having a different focal length. As such, the lenses of each of the NFL elements 42*a* and 42*b* can work together to collimate the incident light from the sources 44*a* and 44*b*.

As also depicted in FIGS. 1-1C, the vehicle headlamp assembly 40 can include the case 50 having depth 50*d*, width 50*w* and height 50*h* dimensions. The depth 50*d* can be defined by the distance from the LED sources 44*a* and 44*b* to the exit surface 48. In one exemplary implementation, the case 50 has a depth 50*d* of approximately 28 mm, a height 50*h* of approximately 60 mm and a width 50*w* of approximately 32 mm. The packaging footprint, including depth 50*d*, of the case 50 can be minimized based on the particular construction of the lens 41. The lens 41 consists of at least two lens modules 52 and 54. These lens modules 52 and 54 are not merely single elements joined together to form lens 41. Rather, the input surfaces 46*a* and 46*b*, the exit surface 48, and the exit surface elements 49*a* and 49*b* are designed such that the lens modules 52 and 54 are merged together to form lens 41. In some embodiments of vehicle headlamp assembly 40, the case 50 and lens 41 are configured such that the depth 50*d* is set at 50 mm or less. In other aspects of the headlamp assembly 40, the depth 50*d* is set at 30 mm or less.

In some embodiments, the vehicle headlamp assembly 40 can include a case 50, a lens 41 having a plurality of lens modules (e.g., lens modules 52, 54, and more) and an exit surface 48. Each lens module is paired with an LED lighting source (e.g., LED light sources 44*a*, 44*b*, and so on) that directs incident light through the respective lens module and out of the exit surface 48. Further, the lens modules are configured to produce a spread pattern 43*a* and spot pattern 43*b*. One subset of the plurality of the lens modules can be devoted to producing the spread pattern 43*a* and the remainder of the lens modules can be configured to produce the spot pattern 43*b*. In some aspects, the exit surface 48 is itself divided into discrete exit surface elements (e.g., exit surface elements 49*a*, 49*b*, and so on) that correspond to particular lens modules. These exit surface elements can also be configured and optimized to produce the respective spot and spread patterns 43*a* and 43*b* for the vehicle headlamp assembly 40. In other embodiments, the vehicle headlamp assembly 40 can include one or more lens modules 52 or 54 configured to solely produce spread or spot patterns 43*a* and 43*b*. Put another way, some embodiments of headlamp assembly 40 are configured to produce only spread pattern 43*a* or spot pattern 43*b*, as necessary for certain lighting applications.

Figure 2:
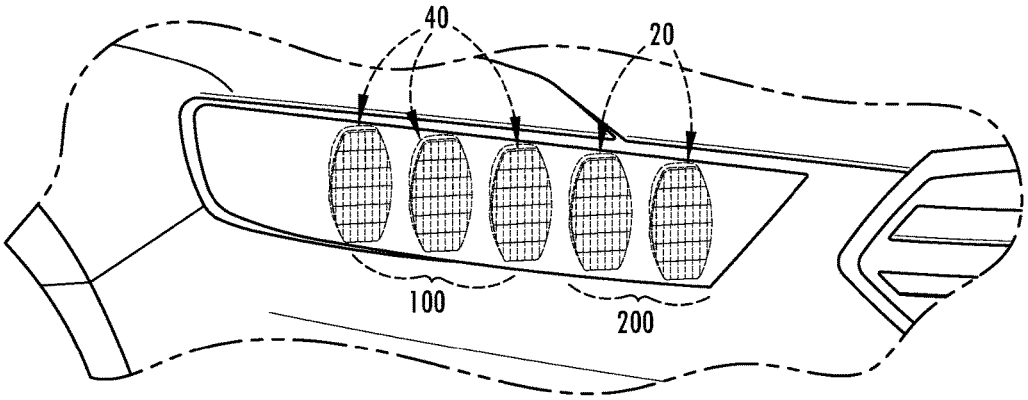
FIG. 2 is a perspective view of an arrangement of vehicle headlamp assemblies employed in low and high beam headlamp assemblies according to an aspect of the disclosure.
Figure 3:
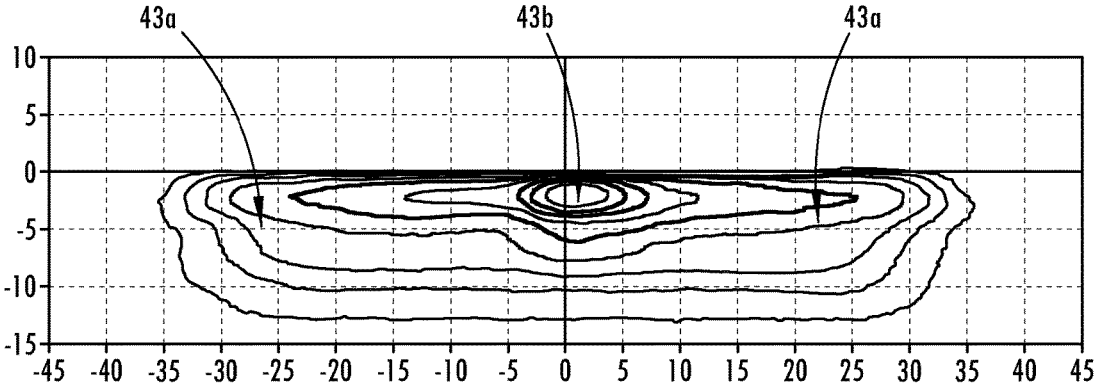
FIG. 3 is a plot of luminous intensity for a low beam headlamp assembly as depicted in FIG. 2 according to a further aspect of the disclosure.

Referring now to FIG. 2, a low beam headlamp assembly 100 can consist of a set of three headlamp assemblies 40. Further, a high beam headlamp assembly 200 can also consist of two headlamp assemblies 20. With regard to the low beam headlamp assembly 100, the outermost headlamp assemblies 40 can be configured to produce only spread patterns 43*a*. For example, two sets of lens modules 52 can be employed for the outermost headlamp assemblies 40. As for the centermost headlamp assembly 40 within the low beam headlamp assembly 100, it can be configured to produce spread and spot patterns 43*a* and 43*b*, respectively. The spread and spot patterns 43*a* and 43*b* collectively produced by the headlamp assemblies 40 of the low beam headlamp assembly 100 can satisfy the FMVSS 108, for example, As shown in FIG. 3, a low beam vehicle headlamp assembly 100 with three headlamp assemblies 40 according to an embodiment (see, e.g., FIG. 2) can be used to generate a light pattern that satisfies the low beam FMVSS 108 requirements. The hot spot pattern 43*b* is shown in the relative center of the pattern with high intensity levels (e.g., luminous intensity levels of 15000 candelas (cd) or more). In some aspects, the spot pattern 43*b* can be produced solely by the topmost lens module 54 of the centermost headlamp assembly 40 within the low beam assembly 100. The spread pattern 43*a* is also depicted in FIG. 3, and surrounds the spot pattern 43*b*. The spread pattern 43*a*, as shown in FIG. 3, has intensity levels that range from 125 candelas (cd) to 15000 candelas (cd). In some aspects, the spread pattern 43*a* can be produced by the outermost vehicle headlamp assemblies 40 and a portion of the centermost vehicle headlamp assembly 40 of the low beam assembly 100. As such, a collection of vehicle headlamp assemblies 40, each with one lens 41, case 50 and two LED lighting sources 44*a* and/or 44*b*, can produce a collective lighting pattern suitable for use in a low beam vehicular headlight configuration.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle lighting assembly, comprising:

a single lens having a first and second plurality of near-field lens elements with parabolic input surfaces and a shared exit surface; and a first and second LED source that directs a light through the input surfaces, the first input surface collimating the light into a spread pattern from 125 to 15000 candelas and the second input surface collimating the light into a high-intensity pattern of at least 15000 candelas.

2. The lighting assembly according to claim 1, wherein the first and second plurality of near-field lens elements each consist of at least two near-field lenses.

3. The lighting assembly according to claim 1, wherein the spread pattern and the high-intensity pattern collectively meet the low beam headlight requirements set forth in the current U.S. Federal Motor Vehicle Safety Standard 108.

4. The lighting assembly according to claim 1, wherein the exit surface of the lens is arranged in a substantially rectangular shape.

5. The lighting assembly according to claim 1, wherein the exit surface of the lens comprises a plurality of optical elements configured to further shape the spread and high-intensity patterns into a low-beam vehicular headlight pattern.

6. The lighting assembly according to claim 5, wherein the plurality of optical elements further comprises a substantial portion of optical elements that are dissimilar in terms of at least one of their tip angle and outer curvature.

7. The lighting assembly according to claim 1, wherein the LED sources and the exit surface of the lens collectively define a maximum assembly depth of about 50 mm or less.

8. The lighting assembly according to claim 1, wherein the LED sources and the exit surface of the lens collectively define a maximum assembly depth of about 30 mm or less.

9. A vehicle lighting assembly, comprising:

a single lens having a first and second plurality of near-field lens elements and exit elements; and a first and second LED source directing a light through the lens elements, the first and second plurality of exit elements with dissimilar tip angles and/or outer curvature, each configured to shape the light into a spread pattern from 125 to 15000 candelas or high-intensity pattern of at least 15000 candelas.

10. The lighting assembly according to claim 9, wherein the first and the second plurality of near-field lens elements each comprise at least two near-field lenses.

11. The lighting assembly according to claim 9, wherein the spread pattern and the high-intensity pattern collectively meet the low beam headlight requirements set forth in the current U.S. Federal Motor Vehicle Safety Standard 108.

12. The lighting assembly according to claim 9, wherein the first and second plurality of exit elements are collectively arranged in a substantially rectangular shape.

13. The lighting assembly according to claim 9, wherein the LED sources and the first and second plurality of exit elements collectively define a maximum assembly depth of about 50 mm or less.

14. The lighting assembly according to claim 9, wherein the LED sources and the first and second plurality of exit elements collectively define a maximum assembly depth of about 30 mm or less.

15. A vehicle lighting assembly, comprising:

a single lens having a plurality of lens modules with input surfaces and exit surface elements, and a shared exit surface; and a plurality of LED sources positioned to direct a light through the input surfaces, the first and second plurality of exit elements with dissimilar tip angles and/or outer curvature that, collectively, produce a low-beam pattern, wherein each plurality shapes the light into a spread or high-intensity pattern.

16. The lighting assembly according to claim 15, wherein the spread pattern and the high-intensity pattern collectively meet the low beam headlight requirements set forth in the current U.S. Federal Motor Vehicle Safety Standard 108.

17. The lighting assembly according to claim 15, wherein the plurality of LED sources and the exit surface of the lens collectively define a maximum assembly depth of about 50 mm or less.

18. The lighting assembly according to claim 15, wherein the plurality of LED sources and the exit surface of the lens collectively define a maximum assembly depth of about 30 mm or less.

* * * * *